US011117248B2

(12) United States Patent
Murg et al.

(10) Patent No.: US 11,117,248 B2
(45) Date of Patent: Sep. 14, 2021

(54) METHOD AND DEVICE FOR CONVERTING A PLIER TOOL

(71) Applicant: Stride Tool, LLC, Glenwillow, OH (US)

(72) Inventors: Leonard R. Murg, Eastlake, OH (US); Ryan Jarvis, Glenwillow, OH (US)

(73) Assignee: STRIDE TOOL, LLC, Glenwillow, OH (US)

( * ) Notice: Subject to any disclaimer, the term of this patent is extended or adjusted under 35 U.S.C. 154(b) by 764 days.

(21) Appl. No.: 15/729,732

(22) Filed: Oct. 11, 2017

(65) Prior Publication Data

US 2018/0147706 A1 May 31, 2018

Related U.S. Application Data

(60) Provisional application No. 62/426,367, filed on Nov. 25, 2016.

(51) Int. Cl.
*B25B 27/20* (2006.01)
*B25B 7/10* (2006.01)

(52) U.S. Cl.
CPC ..... *B25B 27/205* (2013.01); *B25B 7/10* (2013.01)

(58) Field of Classification Search
CPC ..... B25B 27/205; B25B 7/10; B25B 27/20; B25B 7/06
USPC ..... 81/52, 394, 409, 409.5, 485
See application file for complete search history.

(56) References Cited

U.S. PATENT DOCUMENTS

| | | | | |
|---|---|---|---|---|
| 252,248 | A * | 1/1882 | Pease | B25B 7/10 81/394 |
| 5,305,670 | A * | 4/1994 | Fossella | B25B 13/44 81/128 |
| 5,865,075 | A * | 2/1999 | Medved | B25B 27/205 29/229 |
| 6,976,412 | B1 * | 12/2005 | Yu | B25B 7/00 29/229 |
| 7,891,903 | B2 * | 2/2011 | Klingenberg | B25B 31/005 403/322.2 |
| 2013/0019720 | A1 * | 1/2013 | Harrison | B25B 27/205 81/409.5 |

* cited by examiner

*Primary Examiner* — David B. Thomas
(74) *Attorney, Agent, or Firm* — Tarolli, Sundheim, Covell & Tummino LLP

(57) ABSTRACT

A pushbutton plier device and a method for converting a plier tool is provided. The pushbutton plier device includes a locking assembly. The locking assembly has a pushbutton and a housing. The pushbutton has a pushbutton body. The pushbutton body has at least one blocking member recess. The housing has a housing body. The housing body is configured to selectively contain a blocking member. The pushbutton plier device has a first plier handle and a second plier handle. The first plier handle has at least one first plier handle aperture. The second plier handle has at least one second plier handle aperture. When the first plier handle, the second plier handle, and the locking assembly are selectively joined together in a predetermined position, the locking assembly, located within the first plier handle aperture and the second plier aperture, secures the first plier handle to the second plier handle.

22 Claims, 4 Drawing Sheets

METHOD AND DEVICE FOR CONVERTING A PLIER TOOL

RELATED APPLICATION

This application claims priority from U.S. Provisional Application No. 62/426,367, filed 25 Nov. 2016, the subject matter of which is incorporated herein by reference in its entirety.

TECHNICAL FIELD

This disclosure relates to an apparatus and method for use of a pushbutton plier device and, more particularly, to a method for converting a plier tool.

BACKGROUND

Retaining rings may be attached to annular grooves on shafts and ends of shafts to retain members such as, but not limited to, bearings, collars, and other materials on the shaft. Certain retaining rings are fitted internally such that internal pressure is needed to remove and secure the retaining ring within the interior of an annular groove. Other retaining rings are fitted externally such that external pressure is needed to remove and secure the retaining ring within an annular groove formed externally on a shaft. Pliers may be used to remove or secure retaining rings when it is not desirable to use other tools and/or human fingers at the desired work site.

SUMMARY

In an aspect, a pushbutton plier device is provided. The pushbutton has a locking assembly. The locking assembly has a pushbutton. The pushbutton has a pushbutton body. The pushbutton body has at least one blocking member recess. The locking assembly has a housing. The housing has a housing body. The housing body is configured to selectively contain a blocking member. The pushbutton plier device has a first plier handle. The first plier handle has at least one first plier handle aperture. The pushbutton plier device has a second plier handle. The second plier handle has at least one second plier handle aperture. When the first plier handle, the second plier handle, and the locking assembly are selectively joined together in a predetermined position, the locking assembly, located within the first plier handle aperture and the second plier aperture, secures the first plier handle to the second plier handle.

In an aspect, a method for converting a plier tool is provided. A pushbutton plier device is provided. The pushbutton plier device has a locking assembly. The locking assembly has a pushbutton. The pushbutton has a pushbutton body. The pushbutton body has at least one blocking member recess. The locking assembly has housing. The housing has a housing body. The housing is configured to selectively contain a blocking member. The pushbutton plier device has a first plier handle. The first plier handle has at least one first plier handle aperture. The pushbutton plier device has a second plier handle. The second plier handle has at least one second plier handle aperture. The first plier handle is placed into a predetermined relationship with the second plier handle, wherein the first plier handle aperture is longitudinally adjacent to the second plier handle aperture in a first configuration. The locking assembly is placed in a first position. The pushbutton head is depressed to move the locking assembly into a second position. The locking assembly is maintained in the second position. The locking assembly is inserted through the first handle aperture and the second plier handle aperture with the locking assembly maintained in the second position. The pushbutton head is released to move the locking assembly into the first position, wherein when the locking assembly is in the first position, the blocking member prevents the locking assembly from being removed from the first plier handle aperture and the second plier handle aperture, thereby securing the first plier handle and the second plier handle together in the first configuration. The locking assembly is removed from the first handle aperture and the second plier handle aperture. The first plier handle is placed into a predetermined relationship with the second plier handle, wherein the first plier handle aperture is longitudinally adjacent to the second plier handle aperture in a second configuration. The locking assembly is inserted through the first handle aperture and the second plier handle aperture with the locking assembly maintained in the second position. The pushbutton head is released to move the locking assembly into the first position, wherein when the locking assembly is in the first position, the blocking member prevents the locking assembly from being removed from the first plier handle aperture and the second plier handle aperture, thereby securing the first plier handle and the second plier handle together in the second configuration.

In an aspect, a tool is provided. The tool has first and second plier handles. The first and second plier handles each have a handle portion and a jaw portion. The tool has a locking assembly. The tool has a converting structure that is capable of converting the tool between first and second configurations for opening and closing the jaw portions upon movement of the handle portions with respect to each other. The converting structure has first and second apertures in the second plier handle for the first and second configurations respectively. The converting structure has a locking assembly that is capable of being successively inserted into, and removed from, each of the first and second apertures in the second plier handle. The locking assembly has a pushbutton and housing. The pushbutton has a pushbutton body. The pushbutton body has at least one blocking member recess. The housing has a housing body. The housing body is configured to selectively contain a blocking member.

BRIEF DESCRIPTION OF THE DRAWINGS

For a better understanding, reference may be made to the accompanying drawings, in which.

DESCRIPTION OF EMBODIMENTS

Unless defined otherwise, all technical and scientific terms used herein have the same meaning as is commonly understood by one of skill in the art to which the present disclosure pertains.

As used herein, the term "user" can be used interchangeably to refer to an individual who prepares for, assists, and/or operates a tool.

As used herein, the singular forms "a," "an" and "the" can include the plural forms as well, unless the context clearly indicates otherwise. It will be further understood that the terms "comprises" and/or "comprising," as used herein, can specify the presence of stated features, steps, operations, elements, and/or components, but do not preclude the presence or addition of one or more other features, steps, operations, elements, components, and/or groups thereof.

As used herein, the term "and/or" can include any and all combinations of one or more of the associated listed items.

As used herein, phrases such as "between X and Y" and "between about X and Y" can be interpreted to include X and Y.

It will be understood that when an element is referred to as being "on," "attached" to, "connected" to, etc., another element, it can be directly on, attached to, connected to, coupled with or contacting the other element or intervening elements may also be present. It will also be appreciated by those of skill in the art that references to a structure or feature that is disposed "directly adjacent" another feature may have portions that overlap or underlie the adjacent feature, whereas a structure or feature that is disposed "adjacent" another feature may not have portions that overlap or underlie the adjacent feature.

Spatially relative terms, such as "under," "below," "lower," "over," "upper," "downward" and the like, may be used herein for ease of description to describe one element or feature's relationship to another element(s) or feature(s) as illustrated in the Figures. It will be understood that the spatially relative terms can encompass different orientations of a device in use or operation, in addition to the orientation depicted in the Figures. For example, if a device in the Figures is inverted, elements described as "under" or "beneath" other elements or features would then be oriented "over" the other elements or features.

It will be understood that, although the terms "first," "second," etc. may be used herein to describe various elements, these elements should not be limited by these terms. These terms are only used to distinguish one element from another. Thus, a "first" element discussed below could also be termed a "second" element without departing from the teachings of the present disclosure. The sequence of operations (or steps) is not limited to the order presented in the claims or Figures unless specifically indicated otherwise.

The invention comprises, consists of, or consists essentially of the following features, in any combination.

Figure 1:
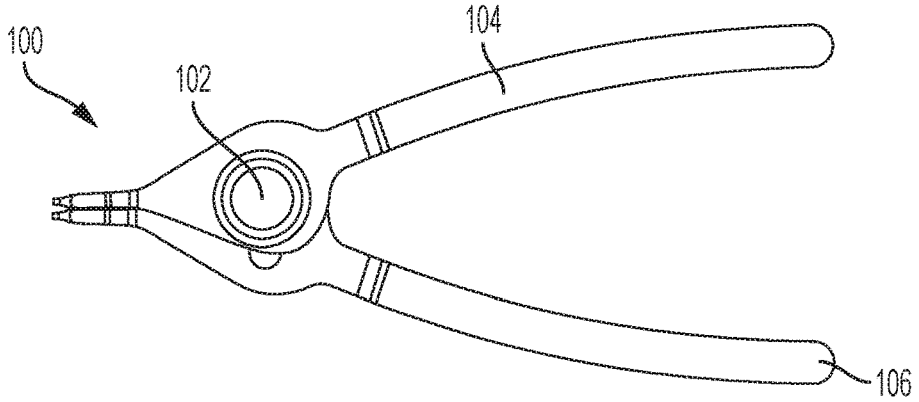
FIG. 1 is a top view of a pushbutton plier device according to one aspect of the present invention.
Figure 2:
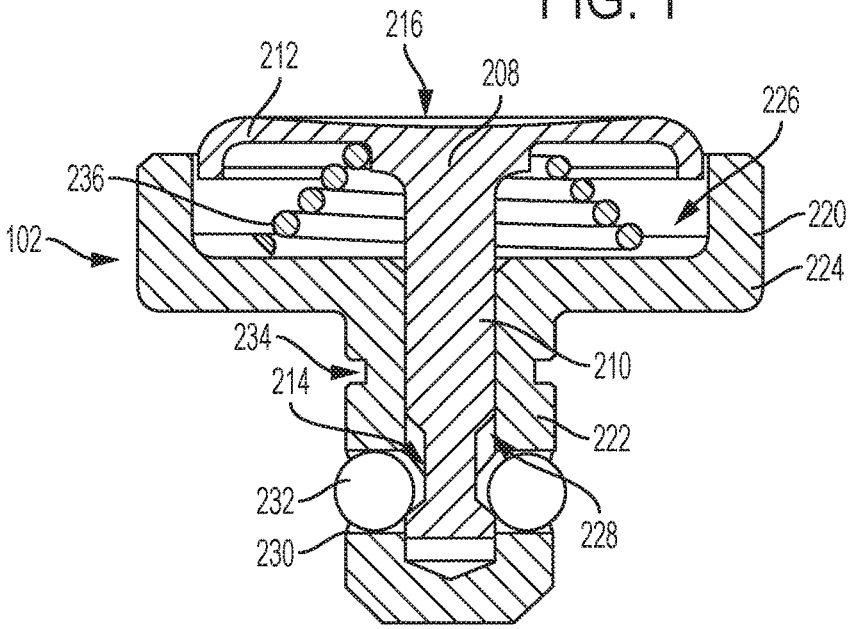
FIG. 2 is a cross-sectional view of an element of the aspect of FIG. 1.

FIG. 1 depicts a pushbutton plier device 100. The pushbutton plier device 100 has a locking assembly 102, a first plier handle 104, and a second plier handle 106. As shown in FIG. 2, the locking assembly 102 has a pushbutton 208. The pushbutton 208 has a pushbutton body 210 and a pushbutton head 212. The pushbutton head 212 can be larger in diameter than the pushbutton body 210. The pushbutton body 210 has at least one blocking member recess 214. The pushbutton head 212 has a pushbutton head first surface 216 and a pushbutton head second surface 218. The pushbutton body 210 extends longitudinally downward from the pushbutton head second surface 218. The term "longitudinal" is used herein to indicate a substantially vertical direction, in the orientation of FIG. 2.

The locking assembly 102 has a housing 220. The housing 220 has a housing body 222 and a housing head 224. The housing body 222 extends longitudinally downward from the housing head 224. The housing head 224 has a housing head recess 226. The housing body 222 has a housing body recess 228. The housing head recess 226 can be larger in diameter than the housing body recess 228. The housing head recess 226 is in fluid connection with the housing body recess 228. The housing head recess 226 has a diameter larger than a corresponding diameter of the pushbutton head 212. The housing body recess 228 has a diameter larger than a corresponding diameter of the pushbutton body 210.

The housing body 210 has at least one housing body opening 230. The housing body opening 230 is configured to selectively contain a blocking member 232 within at least one of the housing body 222 and the housing body opening 230. The blocking member 232 can be at least one of a ball, a rolling member, any translatable member, any other appropriate blocking member, or any combination thereof. The pushbutton plier device 100 can have a retaining ring recess 234 at least partially encircling the housing body 222.

The locking assembly 102 has a biasing member 236. The biasing element 236 can be any appropriate biasing element, such as a spring. The biasing member 236 is positioned at least partially within the housing head recess 226 and between the pushbutton head second surface 218 and the housing head 224. The biasing member 236 biases the locking assembly 102 to a first position, as shown in FIG. 2. When the locking assembly 102 is in the first position, the blocking member recess 214 is laterally offset from the housing body opening 230, thereby securing the blocking member 232 within the housing body opening 230. The term "lateral" is used herein to indicate a direction substantially perpendicular to the "longitudinal" direction, and is shown as the horizontal direction in the orientation of FIG. 2. When the locking assembly 102 is in the first position, the blocking member 232 is prevented from retreating at least partially into the blocking member recess 214.

Figure 3:
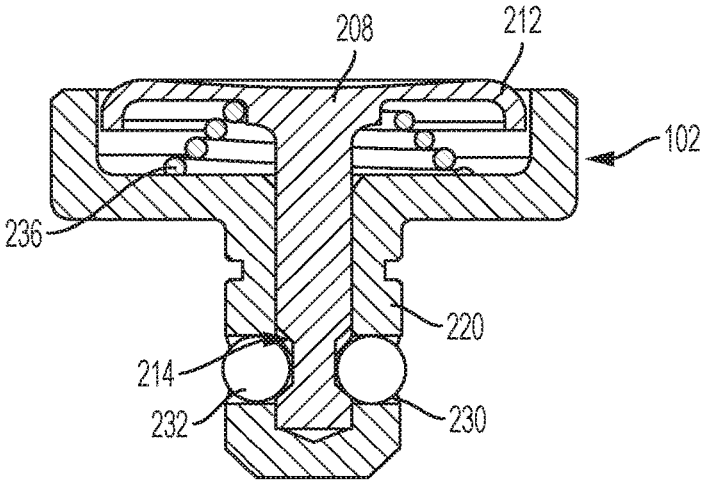
FIG. 3 is a cross-sectional view of an element of the aspect of FIG. 1.

When the pushbutton head 212 is depressed, the locking assembly 102 is transitioned to a second position responsive to the longitudinal progression of the pushbutton 208. The term "progression" is defined herein as the action or process of moving forward or toward a place. As shown in FIG. 3, when the locking assembly 102 is in the second position, the blocking member recess 214 is laterally adjacent to the housing body opening 230, thereby permitting the blocking member 232 to retreat at least partially into the blocking member recess 214 under a biasing force such as an applied laterally inward force from any desired source, e.g., from a user, optionally by the user bringing the blocking member 232 into contact with another structure.

Figure 4:
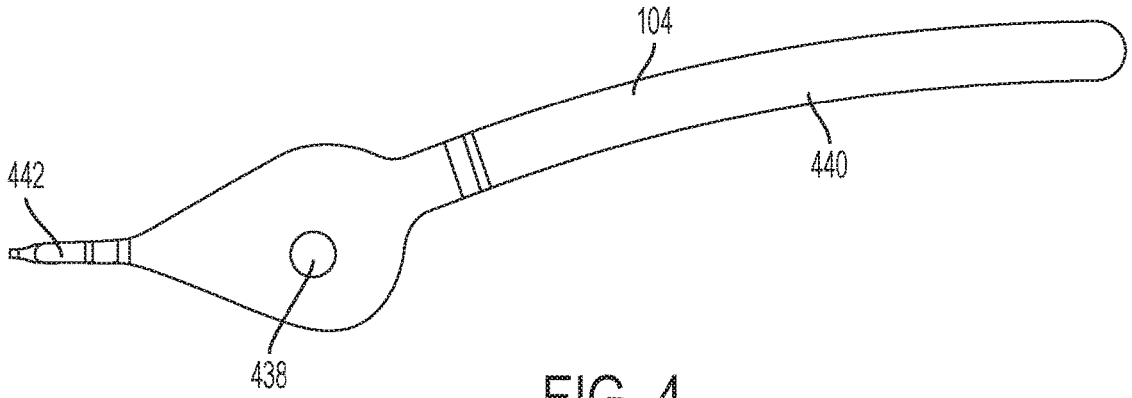
FIG. 4 is a top view of an element of the aspect of FIG. 1.

As shown in FIG. 4, the first plier handle 104 has at least one first plier handle aperture 438. The first plier handle aperture 438 is larger in diameter than the housing body 222 and smaller in diameter than the housing head 224. The first plier handle 104 has a first handle portion 440 and a first jaw portion 442.

Figure 5:
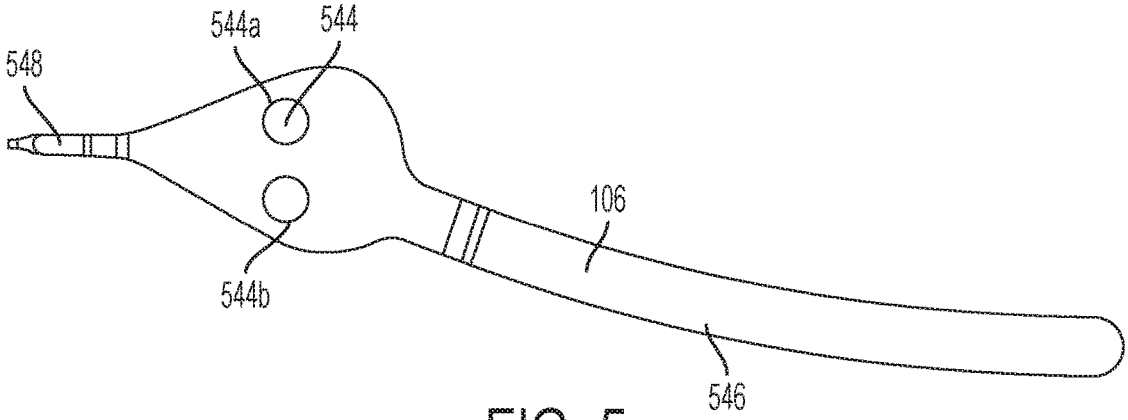
FIG. 5 is a top view of an element of the aspect of FIG. 1.

As shown in FIG. 5, the second plier handle 106 has at least one second plier handle aperture 544. The second plier handle aperture 544 can be at least one of a first configuration aperture **544*a* and a second configuration aperture 544*b*. The second plier handle aperture 544 is larger in diameter than the housing body 222 and smaller in diameter than the housing head 224. The second plier handle 106 has a second handle portion 546 and a second jaw portion 548**.

Figure 6:
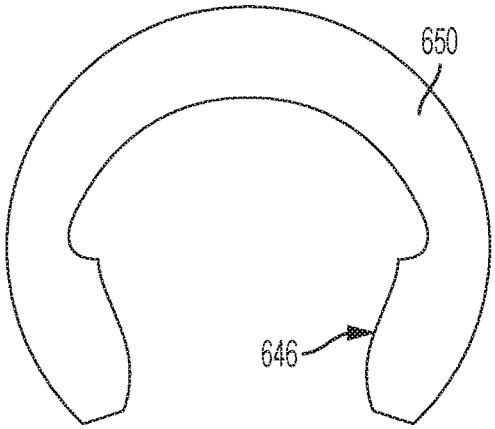
FIG. 6 is a top view of an element of the aspect of FIG. 1.
Figure 7:
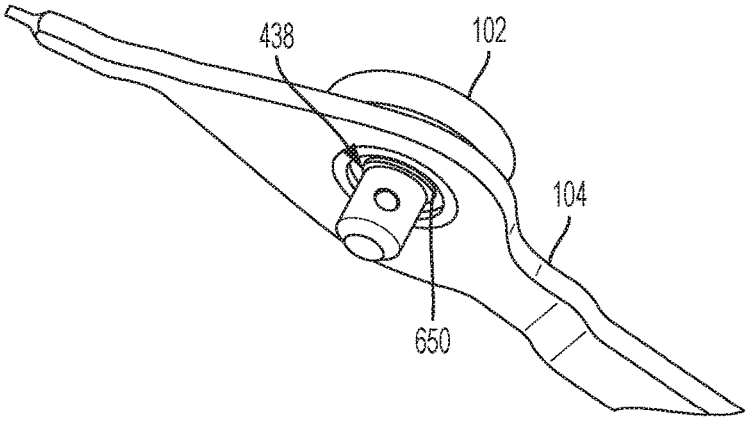
FIG. 7 is a side perspective view of an element of the aspect of FIG. 1.

As shown in FIG. 6, the pushbutton plier device 100 can have a retaining ring 650. The retaining ring 650 has a retaining ring inner wall 652. The retaining ring inner wall 652 has a diameter larger than a corresponding diameter of the retaining ring recess 234. As shown in FIG. 7, when the locking assembly 102, the first plier handle 104, and the retaining ring 650 are joined together, the retaining ring 650 prevents the locking assembly 102 from being removed from the first plier handle aperture 438, thereby securing the locking assembly 102 to the first plier handle 104.

When the first plier handle 104, the second plier handle 106, and the locking assembly 102 are selectively joined together in a predetermined position, the locking assembly 102, located within the first plier handle aperture 438 and the second plier aperture 544, secures the first plier handle 104 to the second plier handle 106. Further, when the first plier handle 104, the second plier handle 106, and the locking assembly 102 are joined together, the locking assembly 102 pivotably connects the first and second plier handles 104, 106 so that movement of the handle portions 440, 546 relative to each other effects opening and closing of the jaw portions 442, 548. The term "pivotably" is defined herein as "so as to be able to pivot". Each of the first plier handle 104 and the second plier handle 106 pivot around the housing body 222 when they are joined together, as described above.

Features of the pushbutton plier device 100 form a converting structure capable of converting the pushbutton plier device 100 between first and second configurations for opening and closing the jaw portions 442, 548 upon movement of the handle portions 440, 546 with respect to each other. The converting structure includes the first configuration aperture 544*a*, the second configuration aperture 544*b*, and the locking assembly 102, as described above. The locking assembly 102 is capable of being inserted into, and removed from, each of the first configuration aperture 544*a* and the second configuration aperture 544*b* for the first and second configurations respectively.

Figure 8:
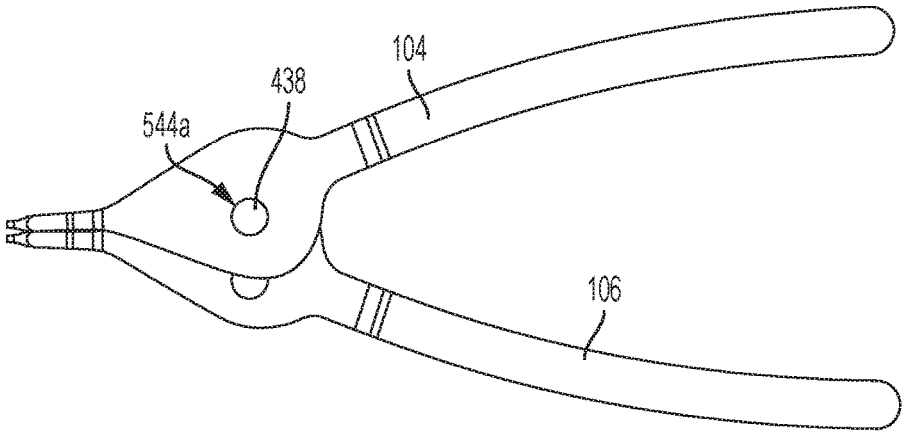
FIGS. 8-13 illustrate an example sequence of operation of a portion of the aspect of FIG. 1.
Figure 9:
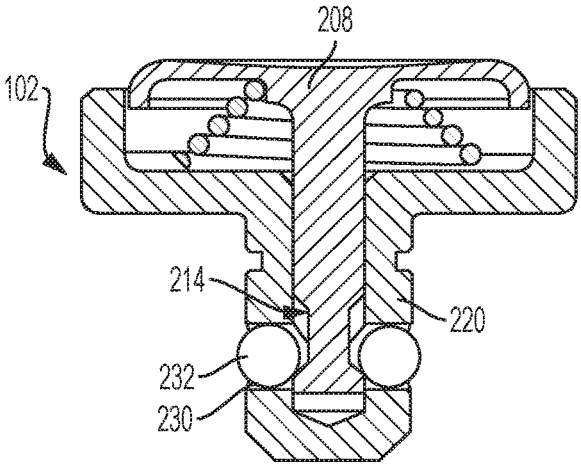

In use, the pushbutton plier device 100, as described above, is provided to the user. As shown in FIG. 8, the first plier handle 104 is placed into a predetermined relationship with the second plier handle 106, wherein the first plier handle aperture 438 is longitudinally adjacent to the second plier handle aperture 544, such as the first configuration aperture 544*a*, in the first configuration. As shown in FIG. 9, the locking assembly 102 is placed in the first position. For example, the blocking member recess 214 is selectively placed in a position that is laterally offset from the housing body opening 230 to prevent the blocking member 232 from retreating at least partially into the blocking member recess 214, thereby securing the blocking member 232 within the housing body opening 230. When the blocking member 232 is secured within the housing body opening 230, the locking assembly 102 is in the first position.

Figure 10:
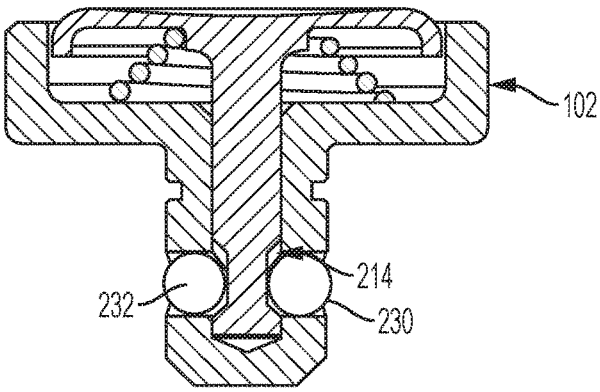

As shown in FIG. 10, the pushbutton head 212 is depressed to move the locking assembly 102 into the second position. For example, the blocking member recess 214 is selectively placed in a position that is laterally adjacent to the housing body opening 230 to permit the blocking member 232 to retreat at least partially into the blocking member recess 214. When the blocking member 232 is permitted to retreat at least partially into the blocking member recess 214, the locking assembly 102 is in the second position. The locking assembly 102 is maintained in the second position.

Figure 11:
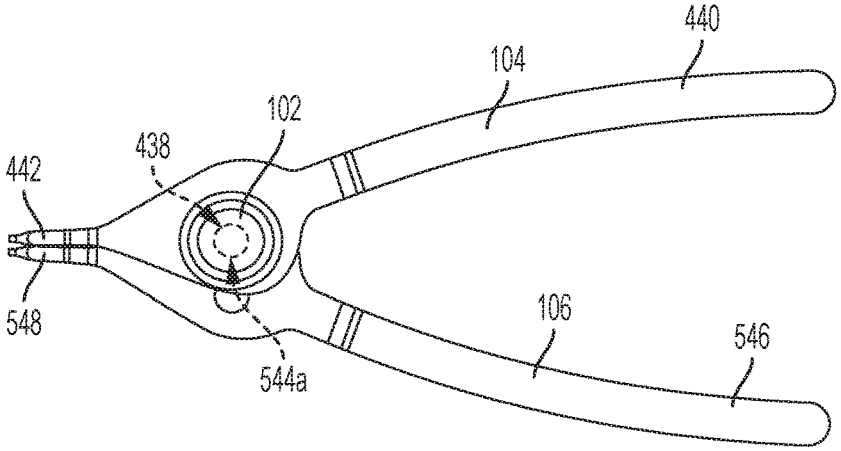

As shown in FIG. 11, the locking assembly 102 is inserted through the first plier handle aperture 438 and the second plier handle aperture 544, such as the first configuration aperture 544*a*, with the locking assembly 102 maintained in the second position. The pushbutton head 212 is released to move the locking assembly 102 into the first position, wherein when the locking assembly 102 is in the first position, the blocking member 232 prevents the locking assembly 102 from being removed from the first plier handle aperture 438 and the second plier handle aperture 544, such as the first configuration aperture 544*a*, thereby securing the first plier handle 104 and the second plier handle 106 together in the first configuration. When the pushbutton plier device 100 is in the first configuration, the locking assembly 102 is located within the first plier handle aperture 438 and the first configuration aperture 544*a*, the first and second plier handles 104, 106 are in a position as shown in FIG. 11, and the jaw portions 442, 548 spread apart when the handle portions 440, 546 are squeezed together by the user. Thus, for example, an external type retaining/snap/lock ring could be manipulated by the user via the first-configuration pushbutton plier device 100.

Figure 12:
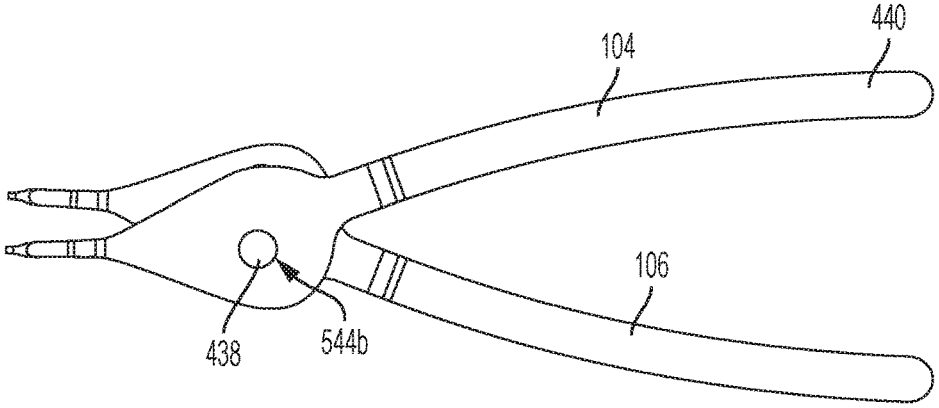

The pushbutton head 212 is depressed to move the locking assembly 102 into the second position. The locking assembly 102 is maintained in the second position. The locking assembly 102 is removed from the first handle aperture 438 and the second plier handle aperture 544, such as the first configuration aperture 544*a*. The pushbutton head 212 can be released to move the locking assembly 102 into the first position. As shown in FIG. 12, the first plier handle 104 is placed into a predetermined relationship with the second plier handle 106, wherein the first plier handle aperture 438 is longitudinally adjacent to the second plier handle aperture 544, such as the second configuration aperture 544*b*, in the second configuration.

Figure 13:
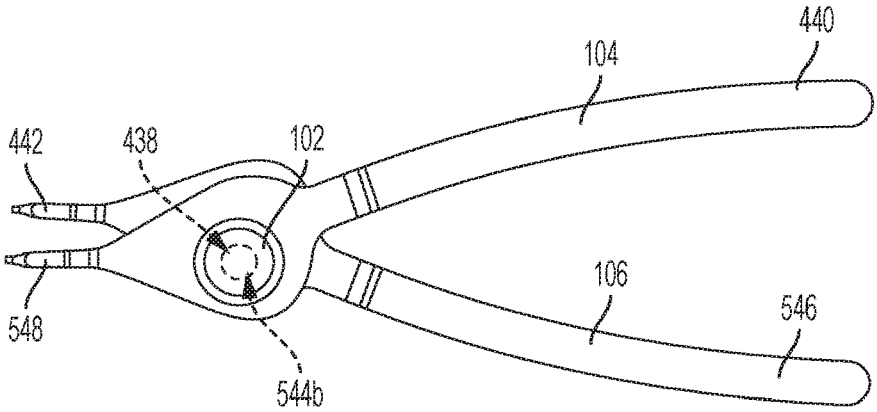

The pushbutton head 212 can be depressed to move the locking assembly 102 into the second position. The locking assembly 102 is maintained in the second position. As shown in FIG. 13, the locking assembly 102 is inserted through the first handle aperture 438 and the second plier handle aperture 544, such as the second configuration aperture 544*b*, with the locking assembly 102 maintained in the second position. The pushbutton head 212 is released to move the locking assembly 102 into the first position, wherein when the locking assembly 102 is in the first position, the blocking member 232 prevents the locking assembly 102 from being removed from the first plier handle aperture 438 and the second plier handle aperture 544, such as the second configuration aperture 544*b*, thereby securing the first plier handle 104 and the second plier handle 106 together in the second configuration.

When the pushbutton plier device 100 is in the second configuration, the locking assembly 102 is located within the first plier handle aperture 438 and the second plier handle aperture 544, such as the second configuration aperture 544*b*, the first and second plier handles 104, 106 are in a position as shown in FIG. 13, and the jaw portions 442, 548 come together or close when the handle portions 440, 548 are squeezed together by the user. Thus, for example, an internal type retaining/snap/lock ring could be manipulated by the user via the second-configuration pushbutton plier device 100. As is shown by the example sequence of operation described above, the pushbutton plier device 100 is convertible between an internal and an external tool.

Further, as described above, the housing body 222 can have the retaining ring recess 234 at least partially encircling the housing body 222. The retaining ring 650, as described above, can be provided. The locking assembly 102 can be inserted into the first plier handle aperture 438. The retaining ring 650 is attached to the retaining ring recess 234. When the locking assembly 102, the first plier handle 104, and the retaining ring 650 are joined together, the retaining ring 650 prevents the locking assembly 102 from being removed from the first plier handle aperture 438, thereby securing the locking assembly 102 to the first plier handle 104. The first plier handle 104, with attached locking assembly 102, can then be joined to the second plier handle 106, as described above.

The locking assembly 102, the first plier handle 104, the second plier handle 106, and/or the retaining ring 650, if provided, can each be at least partially formed from silicone, polyethylene, polypropylene, steel, titanium, any other suitable material, or any combination thereof.

The pushbutton plier device 100 assists the user in operating multiple types of retaining rings without needing to use two separate tools, as mentioned above. For example, certain types of retaining rings require internal pressure, and others require external pressure in order to utilize the retaining ring. The pushbutton plier device 100 being convertible between at least two configurations assists the user in operating these two types of retaining rings without having to use two separate tools.

Although the first plier handle 104 and the second plier handle 106 have been described as plier handles, it is to be understood that the first and second plier handles 104, 106 may be any similar tool handle that facilitates the opening and/or closing of a jaw portion when the handle portions are squeezed together.

Although the pushbutton plier device 100 has been described as having two configurations, it is contemplated that at least one of the first plier handle 104 and the second plier handle 106 may have multiple apertures to allow for more configurations than the two described above.

It is contemplated that the biasing member 236 is located outside of the housing head recess 226 and in any appropriate location for biasing the locking assembly 102 in the first position, such as, but not limited to, the housing body recess 228.

It is contemplated that the pushbutton plier device 100 may have a mechanism, instead of, or in addition to, the blocking member 232, within or on the locking assembly 102 that permits the housing body 222 to pass through the first plier handle aperture 438 and second plier handle aperture 544 and secures the first plier handle 104 and second plier handle together 106, as described above. For example, the pushbutton plier device 100 may have a retaining ring that is capable of being attached to the housing body 222 after the housing body has been inserted through the first and second plier handle apertures 438, 544. The retaining ring prevents the locking assembly 102 from being removed from the first and second plier handle apertures 438, 544, thereby securing the first plier handle 104 and the second plier handle 106 together.

While aspects of this disclosure have been particularly shown and described with reference to the example aspects above, it will be understood by those of ordinary skill in the art that various additional aspects may be contemplated. For example, the specific methods described above for using the apparatus are merely illustrative; one of ordinary skill in the art could readily determine any number of tools, sequences of steps, or other means/options for placing the above-described apparatus, or components thereof, into positions substantively similar to those shown and described herein. In an effort to maintain clarity in the Figures, certain ones of duplicative components shown have not been specifically numbered, but one of ordinary skill in the art will realize, based upon the components that were numbered, the element numbers which should be associated with the unnumbered components; no differentiation between similar components is intended or implied solely by the presence or absence of an element number in the Figures. Any of the described structures and components could be integrally formed as a single unitary or monolithic piece or made up of separate sub-components, with either of these formations involving any suitable stock or bespoke components and/or any suitable material or combinations of materials. Any of the described structures and components could be disposable or reusable as desired for a particular use environment. Any component could be provided with a user-perceptible marking to indicate a material, configuration, at least one dimension, or the like pertaining to that component, the user-perceptible marking potentially aiding a user in selecting one component from an array of similar components for a particular use environment. A "predetermined" status may be determined at any time before the structures being manipulated actually reach that status, the "predetermination" being made as late as immediately before the structure achieves the predetermined status. The term "substantially" is used herein to indicate a quality that is largely, but not necessarily wholly, that which is specified—a "substantial" quality admits of the potential for some relatively minor inclusion of a non-quality item. Though certain components described herein are shown as having specific geometric shapes, all structures of this disclosure may have any suitable shapes, sizes, configurations, relative relationships, cross-sectional areas, or any other physical characteristics as desirable for a particular application. Any structures or features described with reference to one aspect or configuration could be provided, singly or in combination with other structures or features, to any other aspect or configuration, as it would be impractical to describe each of the aspects and configurations discussed herein as having all of the options discussed with respect to all of the other aspects and configurations. A device or method incorporating any of these features should be understood to fall under the scope of this disclosure as determined based upon the claims below and any equivalents thereof.

Other aspects, objects, and advantages can be obtained from a study of the drawings, the disclosure, and the appended claims.

We claim:

1. A pushbutton plier device, comprising:

a locking assembly having:

a pushbutton, the pushbutton having a pushbutton body, the pushbutton body having at least one blocking member recess, and a housing, the housing having a housing body, the housing body being configured to selectively contain a blocking member;

a first plier handle, the first plier handle having at least one first plier handle aperture; and a second plier handle, the second plier handle having at least one second plier handle aperture;

wherein when the first plier handle, the second plier handle, and the locking assembly are selectively joined together in a predetermined position, the locking assembly, located within the first plier handle aperture and the second plier aperture, secures the first plier handle to the second plier handle.

2. The pushbutton plier device of claim 1, wherein when the locking assembly is in a first position, the blocking member recess is laterally offset from a housing body opening, thereby securing the blocking member within the housing body opening.

3. The pushbutton plier device of claim 2, wherein when the locking assembly is in a second position, the blocking member recess is laterally adjacent to the housing body opening, thereby permitting the blocking member to retreat at least partially into the blocking member recess.

4. The pushbutton plier device of claim 1, including a retaining ring recess at least partially encircling the housing body.

5. The pushbutton plier device of claim 4, including a retaining ring, the retaining ring having a retaining ring inner wall, the retaining ring inner wall having a diameter larger than a corresponding diameter of the retaining ring recess, wherein when the locking assembly, the first plier handle, and the retaining ring are joined together, the retaining ring prevents the locking assembly from being removed from the first plier handle aperture, thereby securing the locking assembly to the first plier handle.

6. The pushbutton plier device of claim 1, including:

the locking assembly including a pushbutton head of the pushbutton having a pushbutton head first surface and a pushbutton head second surface, the pushbutton body extending longitudinally downward from the pushbutton head second surface, the housing body extending longitudinally downward from a housing head, the housing head having a housing head recess, the housing body having a housing body recess, the housing head recess being in fluid connection with the housing body recess, the housing head recess having a diameter larger than a corresponding diameter of the pushbutton head, the housing body recess having a diameter larger than a corresponding diameter of the pushbutton body, the housing body having at least one housing body opening, the housing body opening being configured to selectively contain a blocking member within at least one of the housing body and housing body opening, and a biasing member, the biasing member being positioned at least partially within the housing head recess and between the pushbutton head second surface and the housing head, the biasing member biasing the locking assembly to a first position, wherein when the pushbutton head is depressed, the locking assembly is transitioned to a second position responsive to the longitudinal progression of the pushbutton;

the first plier handle aperture being larger in diameter than the housing body and smaller in diameter than the housing head; and the second plier handle aperture being larger in diameter than the housing body and smaller in diameter than the housing head.

7. The pushbutton plier device of claim 6, wherein when the locking assembly is in the first position, the blocking member recess is laterally offset from the housing body opening, thereby securing the blocking member within the housing body opening.

8. The pushbutton plier device of claim 7, wherein when the locking assembly is in the second position, the blocking member recess is laterally adjacent to the housing body opening, thereby permitting the blocking member to retreat at least partially into the blocking member recess.

9. The pushbutton plier device of claim 1, wherein the pushbutton body extends longitudinally downward from a pushbutton head, and the housing body extends longitudinally downward from a housing head, the housing body and head being formed as a single unitary piece, the housing body containing at least a portion of the pushbutton body, the housing head containing at least a portion of the pushbutton head.

10. The pushbutton plier device of claim 1, including a retaining ring encircling the housing body that secures the locking assembly to the first plier handle to prevent the locking assembly from being removed from the first plier handle aperture.

11. A method for converting a plier tool, the method comprising:

providing a pushbutton plier device including:

a locking assembly including a pushbutton, the pushbutton having a pushbutton body, the pushbutton body having at least one blocking member recess, and a housing, the housing having a housing body, the housing being configured to selectively contain a blocking member;

a first plier handle, the first plier handle having at least one first plier handle aperture; and a second plier handle, the second plier handle having at least one second plier handle aperture;

placing the first plier handle into a predetermined relationship with the second plier handle, wherein the first plier handle aperture is longitudinally adjacent to the second plier handle aperture in a first configuration;

placing the locking assembly in a first position;

depressing a pushbutton head of the pushbutton to move the locking assembly into a second position;

maintaining the locking assembly in the second position;

inserting the locking assembly through the first handle aperture and the second plier handle aperture with the locking assembly maintained in the second position;

releasing the pushbutton head to move the locking assembly into the first position, wherein when the locking assembly is in the first position, the blocking member prevents the locking assembly from being removed from the first plier handle aperture and the second plier handle aperture, thereby securing the first plier handle and the second plier handle together in the first configuration;

removing the locking assembly from the first handle aperture and the second plier handle aperture;

placing the first plier handle into a predetermined relationship with the second plier handle, wherein the first plier handle aperture is longitudinally adjacent to the second plier handle aperture in a second configuration;

inserting the locking assembly through the first handle aperture and the second plier handle aperture with the locking assembly maintained in the second position; and releasing the pushbutton head to move the locking assembly into the first position, wherein when the locking assembly is in the first position, the blocking member prevents the locking assembly from being removed from the first plier handle aperture and the second plier handle aperture, thereby securing the first plier handle and the second plier handle together in the second configuration.

12. The method of claim 11, including:

selectively placing the blocking member recess in a position that is laterally offset from a housing body opening to prevent the blocking member from retreating at least partially into the blocking member recess, thereby securing the blocking member within the housing body opening;

wherein when the blocking member is secured within the housing body opening, the locking assembly is in the first position.

13. The method of claim 12, including:

selectively placing the blocking member recess in a position that is laterally adjacent to the housing body opening to permit the blocking member to retreat at least partially into the blocking member recess;

wherein when the blocking member is permitted to retreat at least partially into the blocking member recess, the locking assembly is in the second position.

14. The pushbutton plier device of claim 11, including:

providing a retaining ring recess, the retaining ring recess at least partially encircling the housing body;

providing a retaining ring, the retaining ring having a retaining ring inner wall, the retaining ring inner wall having a diameter larger than a corresponding diameter of the retaining ring recess;

inserting the locking assembly into the first plier handle aperture; and attaching the retaining ring to the retaining ring recess;

wherein when the locking assembly, the first plier handle, and the retaining ring are joined together, the retaining ring prevents the locking assembly from being removed from the first plier handle aperture, thereby securing the locking assembly to the first plier handle.

15. A tool, comprising:

first and second plier handles each having a handle portion and a jaw portion;

a locking assembly having a pushbutton and housing, the pushbutton having a pushbutton body, the pushbutton body having at least one blocking member recess, the housing having a housing body, the housing body being configured to selectively contain a blocking member; and a converting structure capable of converting the tool between first and second configurations for opening and closing the jaw portions upon movement of the handle portions with respect to each other, the converting structure having first and second apertures in the second plier handle for the first and second configurations respectively and the locking assembly capable of being successively inserted into, and removed from, each of the first and second apertures in the second plier handle.

16. The tool of claim 15, including at least one aperture in the first plier handle, wherein the locking assembly is capable of being successively inserted into, and removed from, the aperture in the first plier handle.

17. The tool of claim 16, including a retaining ring recess at least partially encircling the housing body.

18. The tool of claim 16, including a retaining ring, the retaining ring having a retaining ring inner wall, the retaining ring inner wall having a diameter larger than a corresponding diameter of the retaining ring recess, wherein when the locking assembly is inserted into an aperture, the retaining ring prevents the locking assembly from being removed from the aperture.

19. The tool of claim 16, wherein when the first plier handle, the second plier handle, and the locking assembly are joined together, the locking assembly pivotably connects the first and second plier handles so that movement of the handle portions relative to each other effects opening and closing of the jaw portions.

20. The tool of claim 15, including:

the locking assembly including a pushbutton head of the pushbutton having a pushbutton head first surface and a pushbutton head second surface, the pushbutton body extending longitudinally downward from the pushbutton head second surface, the housing body extending longitudinally downward from a housing head, the housing head having a housing head recess, the housing body having a housing body recess, the housing head recess being in fluid connection with the housing body recess, the housing head recess having a diameter larger than a corresponding diameter of the pushbutton head, the housing body recess having a diameter larger than a corresponding diameter of the pushbutton body, the housing body having at least one housing body opening, the housing body opening being configured to selectively contain a blocking member within at least one of the housing body and housing body opening, and a biasing member, the biasing member being positioned at least partially within the housing head recess and between the pushbutton head second surface and the housing head, the biasing member biasing the locking assembly to a first position, wherein when the pushbutton head is depressed, the pushbutton locking assembly is transitioned to a second position responsive to the longitudinal progression of the pushbutton;

the first plier handle aperture being larger in diameter than the housing body and smaller in diameter than the housing head; and the second plier handle aperture being larger in diameter than the housing body and smaller in diameter than the housing head;

wherein when the first plier handle, the second plier handle, and the locking assembly are joined together, the locking assembly pivotably connects the first and second plier handles so that movement of the handle portions relative to each other effects opening and closing of the jaw portions.

21. The tool of claim 20, wherein when the locking assembly is in the first position, the blocking member recess is laterally offset from the housing body opening, thereby securing the blocking member within the housing body opening.

22. The tool of claim 21, wherein when the locking assembly is in the second position, the blocking member recess is laterally adjacent to the housing body opening, thereby permitting the blocking member to retreat at least partially into the blocking member recess.

* * * * *